US011178747B2

(12) United States Patent
Zeisler et al.

(10) Patent No.: US 11,178,747 B2
(45) Date of Patent: Nov. 16, 2021

(54) TARGET SYSTEM FOR IRRADIATION OF MOLYBDENUM WITH PARTICLE BEAMS

(71) Applicant: Triumf, Vancouver (CA)

(72) Inventors: Stefan K. Zeisler, Vancouver (CA); Victoire Hanemaayer, Vancouver (CA); Kenneth R. Buckley, Vancouver (CA)

(73) Assignee: TRIUMF INC., Vancouver (CA)

( * ) Notice: Subject to any disclaimer, the term of this patent is extended or adjusted under 35 U.S.C. 154(b) by 492 days.

(21) Appl. No.: 15/305,198

(22) PCT Filed: Apr. 24, 2015

(86) PCT No.: PCT/CA2015/050343
§ 371 (c)(1),
(2) Date: Oct. 19, 2016

(87) PCT Pub. No.: WO2015/161385
PCT Pub. Date: Oct. 29, 2015

(65) Prior Publication Data

US 2017/0048962 A1 Feb. 16, 2017

Related U.S. Application Data

(60) Provisional application No. 61/983,667, filed on Apr. 24, 2014.

(51) Int. Cl.
*H05H 6/00* (2006.01)
*G21G 1/10* (2006.01)
*G21K 5/08* (2006.01)

(52) U.S. Cl.
CPC ..... *H05H 6/00* (2013.01); *G21G 1/10* (2013.01); *G21K 5/08* (2013.01)

(58) Field of Classification Search
CPC ... H05H 6/00; G21G 1/10; A61B 6/00; G21K 5/08
See application file for complete search history.

(56) References Cited

U.S. PATENT DOCUMENTS 3,924,137 A * 12/1975 Alger ..... H05H 6/00 376/151
6,215,851 B1 * 4/2001 Meilunas ..... H05G 2/00 376/157

(Continued)

FOREIGN PATENT DOCUMENTS

JP 2000-77551 A 3/2000
JP 2006284337 10/2006

(Continued)

OTHER PUBLICATIONS

Dahlgren, Aa. Study of international published experiences in joining copper and copper-alloys. No. SKI-R--97-12. Swedish Nuclear Power Inspectorate, 1997. Relevant p. 66 attached. Full doc available: <https://inis.iaea.org/collection/NCLCollectionStore/_Public/28/050/28050046.pdf>. (Year: 1997).*

(Continued)

*Primary Examiner* — Lily C Garner
(74) *Attorney, Agent, or Firm* — Innovators Legal

(57) ABSTRACT

A target system for irradiation of molybdenum with charged particles from an accelerator to produce technetium and molybdenum radioisotopes. The target system comprises a molybdenum-100 material brazed with a brazing alloy to a backing material. The backing material preferably comprises a dispersion-strengthened copper composite. The brazing alloy comprises copper and phosphorus.

10 Claims, 6 Drawing Sheets

(56) References Cited

U.S. PATENT DOCUMENTS

| | | | | |
|---|---|---|---|---|
| 6,554,179 | B2 * | 4/2003 | Horner | C04B 35/5805 228/122.1 |
| 7,570,741 | B2 * | 8/2009 | Melnychuk | G01T 1/26 378/143 |
| 8,165,269 | B2 * | 4/2012 | Lee | H01J 35/08 378/144 |
| 9,055,658 | B2 * | 6/2015 | Stora | G21G 1/10 |
| 10,418,140 | B2 * | 9/2019 | Yamagata | G21G 4/02 |
| 2011/0235766 | A1 * | 9/2011 | Stora | G21G 1/10 376/151 |
| 2011/0280357 | A1 | 11/2011 | Stevenson | |
| 2013/0301769 | A1 | 11/2013 | Schaffer et al. | |
| 2014/0029710 | A1 * | 1/2014 | Wilson | G21G 1/10 376/189 |
| 2015/0117584 | A1 * | 4/2015 | Yamagata | H05H 3/06 376/194 |
| 2019/0380195 | A1 * | 12/2019 | Radel | H05H 6/00 |

FOREIGN PATENT DOCUMENTS

| | | | |
|---|---|---|---|
| JP | 2006284337 | A * | 10/2006 |
| WO | 2012139220 | | 10/2012 |

OTHER PUBLICATIONS

How to select a Sil-Fos Alloy. Posted by Lucas-Milhaupt Brazing Experts. Aug. 13, 2013. <https://blog.lucasmilhaupt.com/en-us/about/blog/sil-fos-alloy-for-hvacr-and-plumbing>. (Year: 2013).*

E.J. van Lier, et al. Targets for cyclotron production of Tc-99m. Presentation at the 13th International Workshop on Targetry and Target Chemistry, Roskilde, Denmark, Jul. 2010. <https://wttc.triumf.ca/pdf/2010/039_Targets%20for%20Tc-99m%20WTTC13.pdf >. (Year: 2010).*

Metals and alloys. 2 pages, <https://www.bbc.com/bitesize/guides/z8db7p3/revision/2>.*

Notification Concerning Transmittal of International Preliminary Report on Patentability for corresponding PCT Application No. PCT/CA2015/050343, dated Nov. 3, 2016.

Notification of Transmittal of the International Search Report and the Written Opinion of the International Searching Authority, or the Declaration, for PCT/CA2015/050343, dated Jul. 13, 2015.

Pagdon, et al., "Production of Tc-ppm from Naturally Occurring Molybdenum Absent Uranium", 2011 IEEEI/NPSS 24th Symposium on Fusion Engineering, Chicago, IL, pp. 1-4, Jun. 30, 2011.

Office Action for Japanese counterpart application, Japanese Patent Application No. 2016-564182; dated Aug. 8, 2019.

Full Examination Report issued for AU2015251477, dated Jun. 8, 2019.

Van Lier, et al., "Targets for Cyclotron Production of Tc-99m," (2010), pp. 1-2, URL: https://wttc.triumf.ca/pdf/2010/039_Targets%20for%20Tc-99m%20WTTC13.pdf.

* cited by examiner

TARGET SYSTEM FOR IRRADIATION OF MOLYBDENUM WITH PARTICLE BEAMS

TECHNICAL FIELD

The present disclosure pertains to production of technetium-99m and molybdenum-99 from molybdenum-100 using particle accelerators exemplified by cyclotrons. In particular, the present disclosure pertains to target systems for irradiating molybdenum with charged particles to produce technetium and molybdenum radioisotopes.

BACKGROUND

Technetium-99m (Tc-99m) is a widely used radioisotope for nuclear medical diagnostics. It emits gamma rays of 140 keV and decays with a half-life of approximately six hours. Common diagnostic procedures involve labeling a suitable tracer molecule with Tc-99m, injecting the radiopharmaceutical into the patient's body and imaging with radiological equipment.

Currently, Tc-99m is supplied in the form of molybdenum-99/technetium-99m generators. The parent isotope molybdenum-99 (Mo-99) is produced in nuclear reactors. Mo-99 has a half-life of 66 hours which enables its global distribution to medical facilities. The Mo-99/Tc-99m generator uses column chromatography to separate Tc-99m from Mo-99. Mo-99 is loaded onto acidic alumina columns in the form of molybdate, $MoO_4^{2-}$. As the Mo-99 decays it forms pertechnetate, $TcO_4^-$, which can be eluted selectively from the generator column with saline as sodium pertechnetate. The solution containing sodium pertechnetate is then typically added to a radiochemical 'kit' to form an organ-specific radiopharmaceutical.

Several nuclear reactors producing the world's supply of Mo-99 are close to the end of their lifetimes. Some of the main facilities, such as the reactors at Chalk River Laboratories in Ontario, Canada, and the Petten nuclear reactor in the Netherlands, had substantial shut-down periods which caused a world-wide shortage of Mo-99 for medical applications. Significant concerns remain regarding reliable long-term supply of Mo-99.

Small quantities of radioisotopes can be produced for research purposes only, by using beams of accelerated particles generated by accelerators, to interact with Mo-100 targets wherein they cause nuclear transformations resulting in the conversion of Mo-100 to Mo-99. However, the scalability of such systems is limited by numerous problems. For example, the absorption of accelerated particles by the target material results in the concurrent generation of thermal energy, which needs to be dissipated to avoid damage to the target system and to the system components. Some small-scale systems, water cooling may be used to remove the heat loads from the targets, and therefore, constructing the target assemblies wherein the target material is housed, from materials having high thermal conductivities may be used to maximize heat dissipation during bombardment with accelerated particles. Silver and copper may be used for fabrication of the small-scale target assemblies. However, both silver and copper are annealed at temperatures as low as 100° C. if exposed to elevated temperatures for extended periods. Furthermore, these compounds are rapidly and completely annealed at temperatures above 500° C. Such annealing renders the target assemblies and the targets housed therein unable to withstand the mechanical stresses of the water cooling. Additionally, the target material itself may be deformed by thermal stresses during bombardment with accelerated particles.

SUMMARY

The exemplary embodiments of the present disclosure pertain to a target system for the production of technetium and molybdenum radioisotopes from molybdenum metal, for example Tc-99m and Mo-99 from molybdenum-100 (Mo-100) by irradiation with particles from an accelerator, such as a cyclotron.

DESCRIPTION OF THE FIGURES

The drawing described herein is for illustrative purposes only of selected embodiments and is not intended to limit the scope of the present disclosure.

DETAILED DESCRIPTION

Figure 1:
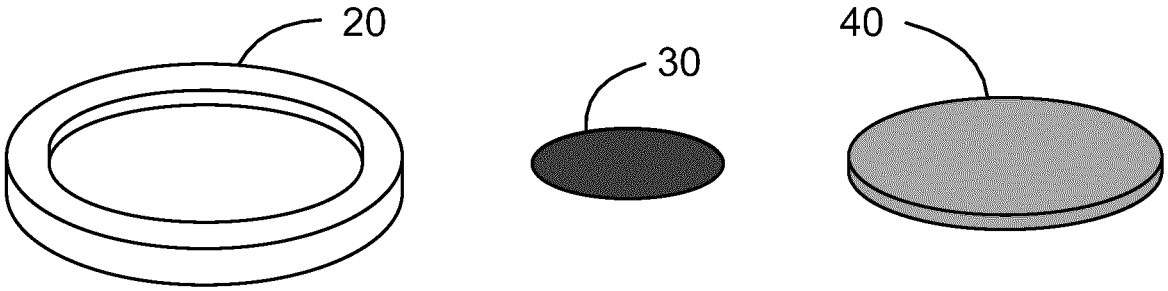
FIG. 1 is a perspective view of the three components of an exemplary Mo-100 target assembly disclosed herein.

Some exemplary embodiments of the present disclosure relate to target assemblies comprising a target holder for housing therein a Mo-100 target for bombardment with accelerated particles, and a bombardment target engaged with the target holder.

Some exemplary embodiments relate to methods for assembling and preparing the target assemblies for bombardment with accelerated particles.

The preparation of metallic molybdenum targets generally needs to be carried out under inert atmosphere if the process requires elevated temperature, as molybdenum reacts rapidly with oxygen if heated to greater than 400° C. Instead of an inert atmosphere, a reducing gas mixture exemplified by hydrogen in argon, may be applied to protect the molybdenum from oxidation and to reduce any molybdenum oxide contained in the target material to molybdenum metal.

The joining of refractory metals such as molybdenum to other materials typically involves intricate multi-step processes. Soldering or brazing of such metals usually requires extensive pre-treatment of the surfaces to be joined (degreasing, sanding, chemical etching, pre-coating with suitable metals) and the application of aggressive, sometimes toxic flux materials. Any soldering or brazing of Mo-100 can only be accomplished under exclusion of oxygen.

An exemplary embodiment of the present disclosure relates to processes for manufacturing a target system consisting of a metallic Mo-100 body that is furnace brazed to a backing material of high thermal conductivity and high mechanical strength. The processes may generally comprise the steps of:

1. Pressing a quantity of molybdenum powder using a mechanical device to form a pressed Mo-100 plate having a desired thickness and size.
2. Sintering the pressed Mo-100 plate in an inert or reducing atmosphere for about 2 to about 20 hours at a temperature from a range of about 1300° C. to about 2100° C.
3. Brazing the sintered plate in a furnace at a temperature from a range of about 500° C. to about 1000° C. in a vacuum, or alternatively in an inert or in a reducing atmosphere, onto a backing made of a dispersion strengthened copper composite material exemplified by GLIDCOP® metal matrix composite alloys (GLIDCOP is a registered trademark of North American Hoganas High Alloys LLC, Hollsopple, Pa., USA), using a brazing filler suitable for producing a bond of high mechanical strength, high thermal conductivity and high ductility between the sintered Mo-100 plate and the backing material.

The exemplary embodiments disclosed herein are described in reference to the manufacture of a solid molybdenum target for the production of Tc-99m by irradiation of a molybdenum target with 16.5 MeV protons, up to, for example, 130 μA beam current in a small medical cyclotron such as the cyclotron exemplified by the GE PETTRACE® (PETTRACE is a registered trademark of the General Electric Company Corp., Schenectady, N.Y., USA). A suitable target assembly for use with the PETTRACE® cyclotron may comprise an exemplary target holder having an outer diameter of about 30 mm and a thickness of about 1.3 mm. The exemplary target holder is provided with a recess that has a diameter of about 20 mm and a depth of about 0.7 mm. A sintered Mo-100 disc having a diameter of about 18.5 mm to about 19.5 mm and a thickness of about 0.6 mm is housed within the recess of the exemplary target holder, and is securely engaged to the target holder by braising.

The first step of an exemplary method for producing the exemplary target assembly housing a sintered Mo-100 target relates to production of a Mo-100 target disc. A selected quantity of commercial Mo-100 powder is transferred into a cylindrical disc form using a cylindrical tool and die set. A pressure is then applied with a hydraulic press to the cylindrical tool and die set containing therein the Mo-100 powder, thereby pressing the Mo-100 powder into a compacted disc. The compacted Mo-100 disc is removed from the die and transferred to a ceramic vessel for further processing.

For example, 20-mm diameter compacted Mo-100 discs can be prepared with a hardened steel cylindrical tool and die set comprising (1) a base with a recess for receiving and positioning a 20-mm diameter spacer pellet, said base configured for receiving and demountably engaging a cylindrical sleeve with an inner bore having a 20-mm diameter, (2) the cylindrical sleeve, and (3) at least two 20-mm diameter spacer pellets. A suitable cylindrical tool and die set is exemplified by a 20-mm diameter ID dry pressing die set from Access International (Livingston, N.J., USA). A small amount of a Vaseline lubricant is spread on the upper, lower, and side surfaces of the two spacer pellets. One of the spacer pellets is placed into the recess of the base, and then the cylindrical sleeve is slipped over the spacer pellet and then engaged with the base. A suitable amount of pre-weighed enriched Mo-100 powder is then poured into the cavity within the cylindrical sleeve and tamped into place. A suitable amount of Mo-100 powder for preparing a 20-mm diameter Mo-100 disc is about 1.6 g. Also suitable are amounts from a range of 0.3 g to 3.0 g, for example, 0.3 g, 0.5 g, 0.75 g, 1.0 g, 1.25 g, 1.5 g, 1.75 g, 2.0 g, 2.25 g, 2.5 g, 2.75 g, 3 g. The second spacer pellet is then inserted into the cavity within the cylindrical sleeve until it is resting on the top of the Mo-100 powder. A piston, which may be provided with the tool and die set, is then inserted into the cavity of the sleeve to engage the top of the second spacer pellet, and then hand pressure is applied to the piston to sandwich the Mo-100 powder between the two spacer pellets. The assembled cylindrical tool and die set is then transferred into a pellet press, or a hydraulic press, or a mechanical press, or the like. A suitable pellet press is exemplified by 40-ton laboratory pellet press with built-in hydraulic pump available from Access International. After the assembled cylindrical tool and die set is installed into the pellet press, a selected pressure is applied to the tool and die set for about 30 sec. A suitable pressure is about 30,000 lbs. Also suitable are pressures from the range of 2,000 lbs to 100,000 lbs, for example 2,000 lbs, 5,000 lbs, 10,000 lbs, 15,000 lbs, 20,000 lbs, 25,000 lbs, 30,000 lbs, 35,000 lbs, 40,000 lbs, 45,000 lbs, 50,000 lbs, 65,000 lbs, 60,000 lbs, 65,000 lbs, 70,000 lbs, 75,000 lbs, 80,000 lbs, 85,000 lbs, 90,000 lbs, 95,000 lbs, 100,000 lbs. After the pressure is released, the cylindrical tool and die set is removed from the pellet press, the tool and die set is disassembled and the pressed Mo-100 disc is removed into a container.

The second step of the exemplary method relates to sintering of the pressed Mo-100 discs in a furnace under a hydrogen/argon atmosphere (e.g. a 2%/98% mixture) at a temperature of about 1700° C. for 5 h. For example, the pressed Mo-100 discs produced in step one of the exemplary process, can be placed into alumina boats having a flat bottom face. An alumina piece is placed, as a weight, on top of each pressed Mo-100 disc in an alumina boat which is then placed into a furnace after which, a flow of a 2%/98% hydrogen/argon gas mixture is started at a pressure of about 2 PSI and a flow rate of about 2 L/min. The temperature is then ramped up from ambient temperature, for example 22° C., to 1,300° C. at a rate of 5° C./min. Then, the temperature is ramped up from 1,300° C. to 1,700° C. at a rate of 2° C./min. The furnace is then held at 1,700° C. for 5 h after which, it is cooled from 1,700° C. to 1,300° C. at a rate of 2° C./min, and then to ambient temperature at a rate of 5° C. The cooled sintered Mo-100 discs are then assessed for suitability for bombardment with accelerated particles. Only those sintered Mo-100 discs that are flat and do not show any evidence of cracks are selected for the third step of the exemplary method.

Figure 2:
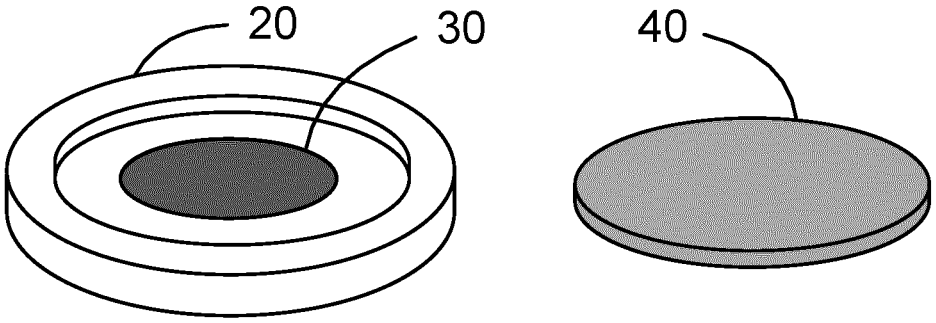
FIG. 2 is a perspective view showing an assembly of two of the components shown in FIG. 1.
Figure 3:
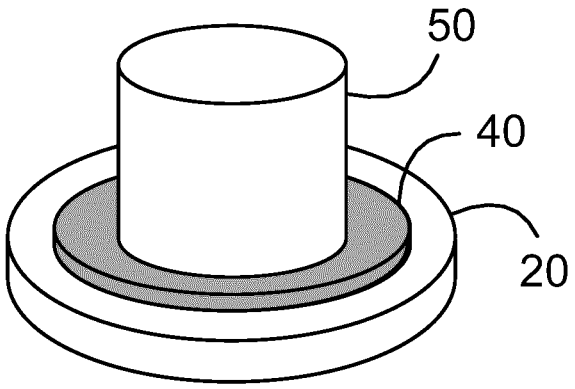
FIG. 3 is a perspective view of the three components shown in FIG. 1, assembled with a tantalum weight holding the components in place.

The third step of the exemplary method relates to preparation of an exemplary target assembly. A target holder 20 (FIGS. 1, 2) is fabricated from a dispersion strengthened copper composite backing exemplified by GLIDCOP® AL-15 having a recess large enough to fit the sintered plate. A suitable size for a target holder (for example, item 20 in FIGS. 1, 2) for the PETTRACE® cyclotron is an outer diameter of 30 mm with a thickness of about 1.3 mm, and has a recess with a diameter of about 20 mm and a depth of about 0.7 mm. The recess of target holder is roughened for example, with a very fine emery paper or steel wool after which, the target holder is washed in a cleaning solution, dried, then placed into methanol and sonicated for about 5 min, then dried. A piece of a suitable brazing material 30 having a diameter of about 12 mm, is then placed into the recess of the target holder 20. Suitable brazing materials are silver-copper-phosphorus brazing fillers exemplified by SIL-FOS® (SIL-FOS is a registered trademark of Handy & Harman Corp., White Plains, N.Y., USA). Next, a sintered Mo-100 disc is placed on top of the brazing material after which, a weight 50 (FIG. 3) exemplified by a tantalum pellet is placed on top of the sintered Mo-100 disc to prevent the stacked components from moving during the brazing process. The target assembly is heated in a brazing furnace under an argon/hydrogen atmosphere (e.g. 98%:2%) to approximately 750° C. and kept at this temperature for 1 h, and then cooled to room temperature.

It should be noted that selection of an appropriate brazing filler metal is of particular importance for the successful joining of sintered Mo-100 discs to GLIDCOP® backing materials. For example, a SIL-FOS® product sold in the USA under the trade name Mattiphos (Johnson Matthey Ltd., Brampton, ON, CA) comprises a group of silver-copper-phosphorus materials of the approximate composition Ag 2-18%, Cu 75-92%, P 5-7.25%, which are mainly used for brazing copper and certain copper alloys. SIL-FOS® is commercially available as rod, strip, wire or foil. SIL-FOS® melts in the range of about 644° C. to about 800° C. and has a flow point of approximately 700° C. Joints brazed with SIL-FOS® are very ductile. If applied to pure copper, the phosphorus enables a self-fluxing capability. Brass, bronze and other copper alloys require a separate flux, but GLIDCOP® can be brazed with SIL-FOS® only, thus eliminating the need for a cleaning procedure after the brazing. Although SIL-FOS® type brazing fillers were initially developed for copper to copper brazing, it was found that they also bond to some refractory metals such as molybdenum. The molybdenum body to be brazed with GLIDCOP® may be present as a foil, plate, pellet, pressed, sintered or any other self-supporting structure.

Figure 4:
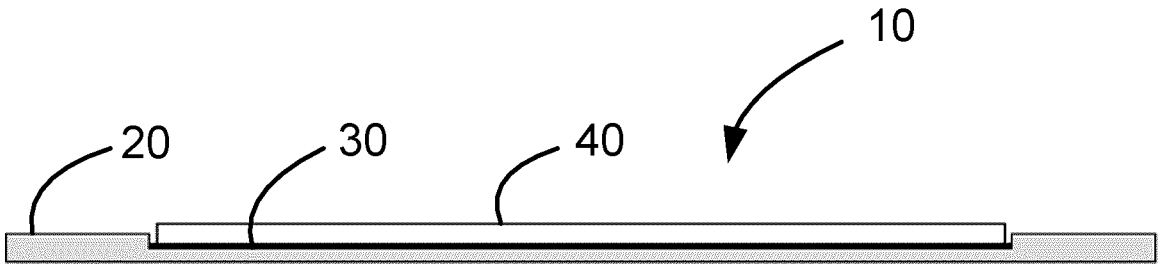
FIG. 4 is a side view of an exemplary assembled Mo-100 target assembly.
Figure 5:
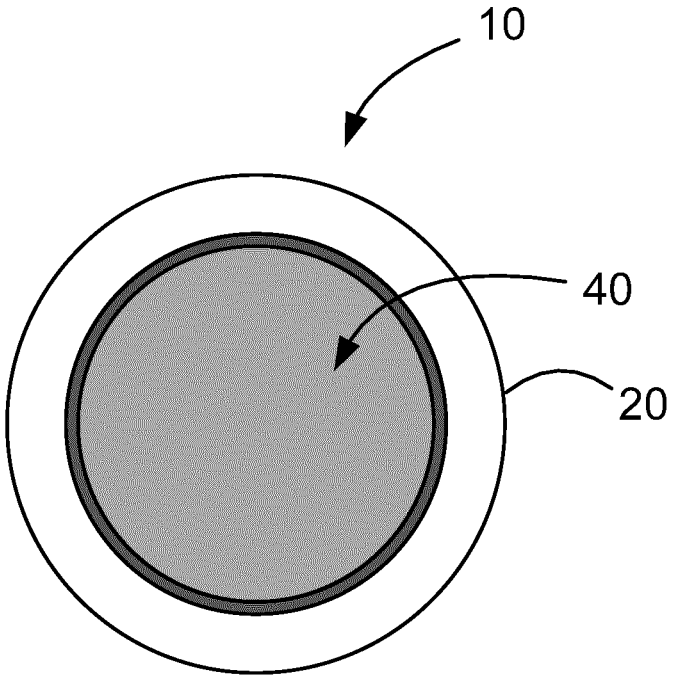
FIG. 5 is a top view of the exemplary assembled Mo-100 target assembly.
Figure 6:
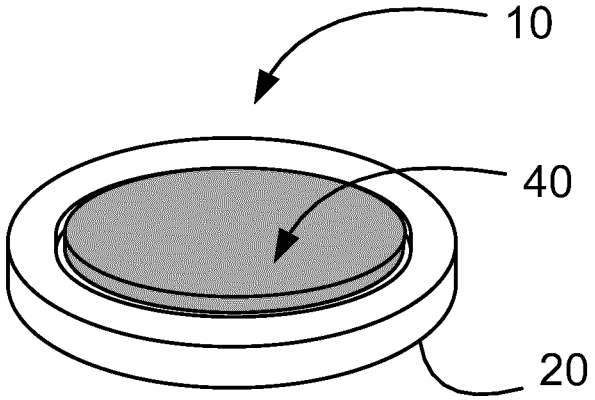
FIG. 6 is a perspective view of the exemplary assembled Mo-100 target assembly.

The process described above yields an exemplary Mo-100 target system 10 (FIGS. 4, 5, 6) for the irradiation of Mo-100 with high power particle beams, such as protons from a cyclotron. The exemplary Mo-100 target system 10 comprises (i) a backing material 20 comprising a dispersion-strengthened copper composite, (ii) a self-supporting sintered Mo-100 target material 40, and (iii) a brazed material 30 interposed between and engaging the backing material 20 and the Mo-100 target material 40.

The selection of a dispersion strengthened copper composite as backing material provides several advantages over other materials with high thermal conductivity The brazing process described above reliably joins a sintered molybdenum plate to a GLIDCOP® backing. SIL-FOS® affords a uniform, mechanically solid but ductile interface between the two components of the assembly. This ductility of the brazing joint plays a major role in regards to its durability under irradiation conditions. During bombardment with high energy protons the incident beam is primarily absorbed in the molybdenum, which causes a substantial temperature rise in the molybdenum plate. The thermal expansion coefficients of molybdenum (4.8 μm/m·K) and GLIDCOP® (16.6 μm/m·K) are remarkably different. Thermal stress effects between the beam heated molybdenum and the cooled GLIDCOP® backing are mitigated by the ductile SIL-FOS® interface layer, thus contributing to the mechanical stability of the assembly without compromising the adhesion of the molybdenum plate to the backing.

While the exemplary embodiments disclosed herein have been specified in reference to their use with a PETTRACE® cyclotron, those skilled in these arts will understand that the dimensions of the target holders and the pressed Mo-100 discs disclosed herein can be modified to produce target holders and pressed Mo-100 discs suitable for use with other apparatus that generate accelerated particles.

The invention claimed is:

1. A molybdenum-100 target assembly comprising:
- a sintered molybdenum-100 disc;
- a target holder provided with a recess having a flat surface for receiving therein the sintered molybdenum-100 disc, the target holder comprising a dispersion-strengthened copper composite; and
- an intermediate layer comprising a brazing alloy of copper and phosphorus therebetween,
- wherein the intermediate layer is engagingly brazed in between the sintered molybdenum-100 disc and the flat surface of the recess in the target holder.

2. A method of making a molybdenum-100 target assembly, comprising:
- preparing a pressed molybdenum-100 disc;
- sintering the pressed molybdenum-100 disc;
- brazing the sintered molybdenum-100 disc into a recess provided in a target holder,
- thereby producing the molybdenum-100 target assembly of claim 1.

3. The method of claim 2, wherein the step of preparing the pressed molybdenum-100 disc comprises:
- placing a selected amount of a molybdenum-100 powder into a cylindrical tool and die set, and
- applying a selected pressure thereto for at least 30 sec.

4. The method of claim 3, wherein the selected amount of molybdenum-100 powder is selected from a range of 0.3 g to 3 g.

5. The method of claim 3, wherein the selected amount of molybdenum-100 powder is 1.6 g.

6. The method of claim 3, wherein the selected pressure is selected from a range of 2,000 lbs to 100,000 lbs.

7. The method of claim 3, wherein the selected pressure is 30,000 lbs.

8. The method of claim 2, wherein the step of sintering the pressed molybdenum-100 disc comprises:
- increasing the temperature from ambient to 1,300° C. at a rate of 5° C./min;
- increasing the temperature from 1,300° C. to 1,700° C. at a rate of 2° C./min;
- maintaining the temperature at 1,700° C. for 5 h;
- decreasing the temperature from 1,700° C. to 1,300° C. at a rate of 2° C./min; and
- decreasing the temperature from 1,300° C. to ambient at a rate of 5° C.

9. The molybdenum-100 target assembly of claim 2, wherein the dispersion-strengthened copper composite comprises aluminum oxide ceramic particles.

10. The molybdenum-100 target assembly of claim 3, wherein the brazing alloy comprises a range of 2-18 wt % silver, a range of between 75-92 wt % copper, and a range of 5-7.25 wt % phosphorus.

* * * * *